US006123176A

United States Patent [19]

O'Donnell et al.

[11] Patent Number: 6,123,176

[45] Date of Patent: Sep. 26, 2000

[54] ROPE TENSION MONITORING ASSEMBLY AND METHOD

[75] Inventors: Hugh J. O'Donnell, Longmeadow, Mass.; Thomas J. Hoffman, Unionville; Frederick H. Barker, Bristol, both of Conn.

[73] Assignee: Otis Elevator Company, Farmington, Conn.

[21] Appl. No.: 08/996,555

[22] Filed: Dec. 23, 1997

Related U.S. Application Data

[63] Continuation-in-part of application No. 08/655,043, May 28, 1996, abandoned.

[51] Int. Cl.[7] ..... B66B 1/34

[52] U.S. Cl. ..... 187/393

[58] Field of Search ..... 187/391, 393, 187/390, 392

[56] References Cited

U.S. PATENT DOCUMENTS

| | | | |
|---|---|---|---|
| 3,672,214 | 6/1972 | Yasuda | 73/144 |
| 4,467,895 | 8/1984 | Smith et al. | 187/29 R |
| 5,731,528 | 3/1998 | Yamazaki et al. | 73/862.41 |
| 5,886,308 | 3/1999 | Erickson et al. | 187/393 |
| 5,890,564 | 4/1999 | Olsen et al. | 187/250 |

FOREIGN PATENT DOCUMENTS

| | | |
|---|---|---|
| 0154288 | 3/1982 | Germany . |
| 1-152316 | 6/1989 | Japan . |
| 3-98975 | 4/1991 | Japan . |

*Primary Examiner*—Jonathan Salata

[57] ABSTRACT

An elevator rope tension monitoring assembly is disclosed. The rope tension monitoring system includes a plurality of sensors that produce an output corresponding to the level of tension in each of the ropes. A controller compares the relative levels of sensed tension and generates a warning signal if a sufficient deviation in the relative level of tension in the ropes is observed.

29 Claims, 2 Drawing Sheets

ROPE TENSION MONITORING ASSEMBLY AND METHOD

CROSS-REFERENCE TO RELATED APPLICATION

This application is a continuation-in-part of prior patent application Ser. No. 08/655,043 entitled "System For Sensing Unequal Tension in Elevator Ropes" filed May 28, 1996 (now abandoned) and assigned to Applicants' Assignee. This pending application is incorporated herein by reference.

TECHNICAL FIELD

The present invention relates to elevator systems, and more particularly to methods and assemblies for monitoring elevator ropes.

BACKGROUND OF THE INVENTION

Hoisting ropes for elevators are used to provide the necessary lifting forces and traction forces for moving the elevator car. Hoisting ropes are typically formed from steel wire strands woven together to form the rope. Such hoisting ropes have proven to be very durable and dependable. A drawback to the use of steel wire ropes is their weight. As the rise of the elevator increases, the portion of the load resulting from the mass of the rope increases. This produces a limitation on the rise of the elevator and the required output of the lifting equipment.

Lightweight, non-metallic materials have been suggested to replace the steel wire ropes. High strength, polyaramid materials, such as KEVLAR, are being investigated for use in elevator applications. These ropes would be formed from polyaramid fibers woven to form strands, which are then woven together to form the rope. An outer jacket may then be used to protect the woven fibers from damage and wear, and to provide the necessary traction to move the elevator car.

An area of concern is how to inspect such synthetic ropes to determine if the rope should be discarded and replaced with a new rope. The current inspection methods for steel wire rope includes visually inspecting the rope to determine the number of broken steel wires in a given length of steel rope. If a predetermined maximum number of broken wires is detected, the steel rope is discarded. This method is not applicable to synthetic fiber ropes having an outer jacket.

One previously known method is to place an electrically conductive member within the rope. The status of the conductive member may be tested by applying an electrical current to the member. If damage occurs to an extent great enough to break the conductive member, the electrical circuit is broken. There are several drawbacks to this method. First, there is no assurance that the loss of electrical continuity is the result of damage to the rope. Second, there is no qualitative information to indicate if the rope is degrading during use. The first indication is provided by the broken conductive member.

The above art notwithstanding, scientists and engineers under the direction of Applicants' Assignee are working to develop methods and apparatus to monitor hoisting ropes.

DISCLOSURE OF THE INVENTION

The present invention is predicated in part upon the recognition that as a hoisting rope degrades, the fibers and strands begin to fail. If a particular rope or section thereof in a elevator system is failing prematurely, this particular rope (or section) will carry less load than each of the remaining ropes that is not failing prematurely. Monitoring the load carried by each rope provides an indication of the level of degradation of each rope.

According to the present invention, a rope monitoring system includes a plurality of tension sensors, with each sensor engaged with one of a plurality of ropes. As a result of the present invention, the tension in each rope can be monitored during operation of the elevator system.

According to a particular embodiment, the rope monitoring system includes a controller that communicates with the sensors and compares each of the sensed tension levels with an appropriate measure. The appropriate measure may be a predetermined level, it may be a value based upon the sensed tension levels in the remaining ropes, it may be a value based upon the measured load in the car, or a combination of these values. Upon determining that one or more of the sensed tension levels deviates from the appropriate measure by more than a predetermined threshold, the controller generates a warning signal. The warning signal indicates that the ropes require inspection and/or replacement. As an alternative, the sensed tension levels and/or the warning signal from the controller may be communicated with an remote monitoring system for the elevator system. In this configuration, the information could be used to dispatch a service representative to inspect the ropes.

According to another embodiment of the present invention, a method to monitor ropes includes the steps of operating the elevator system and sensing the tension in each of the ropes during the operation of the elevator system. Further embodiments of this method include the steps of generating a warning signal if the sensed tension deviates from an appropriate measure, and communicating the tension levels and/or the warning signal to a remote monitoring device.

According to a further particular configuration, the rope monitoring system includes a pair of tension sensors for each rope. Each pair of tension sensors is engaged with one of the ropes and on opposite sides of the sheave. In this configuration, the controller generates a warning signal if the sensed tension in one of the ropes deviates from one side of the sheave to the other by more than a predetermined amount. According to a further embodiment of this configuration, a method to monitor ropes includes the steps of sensing the tension of the ropes on each side of the sheave and generating a warning signal if the tension within the rope deviates from one side of the sheave to the other by more than a predetermined amount.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
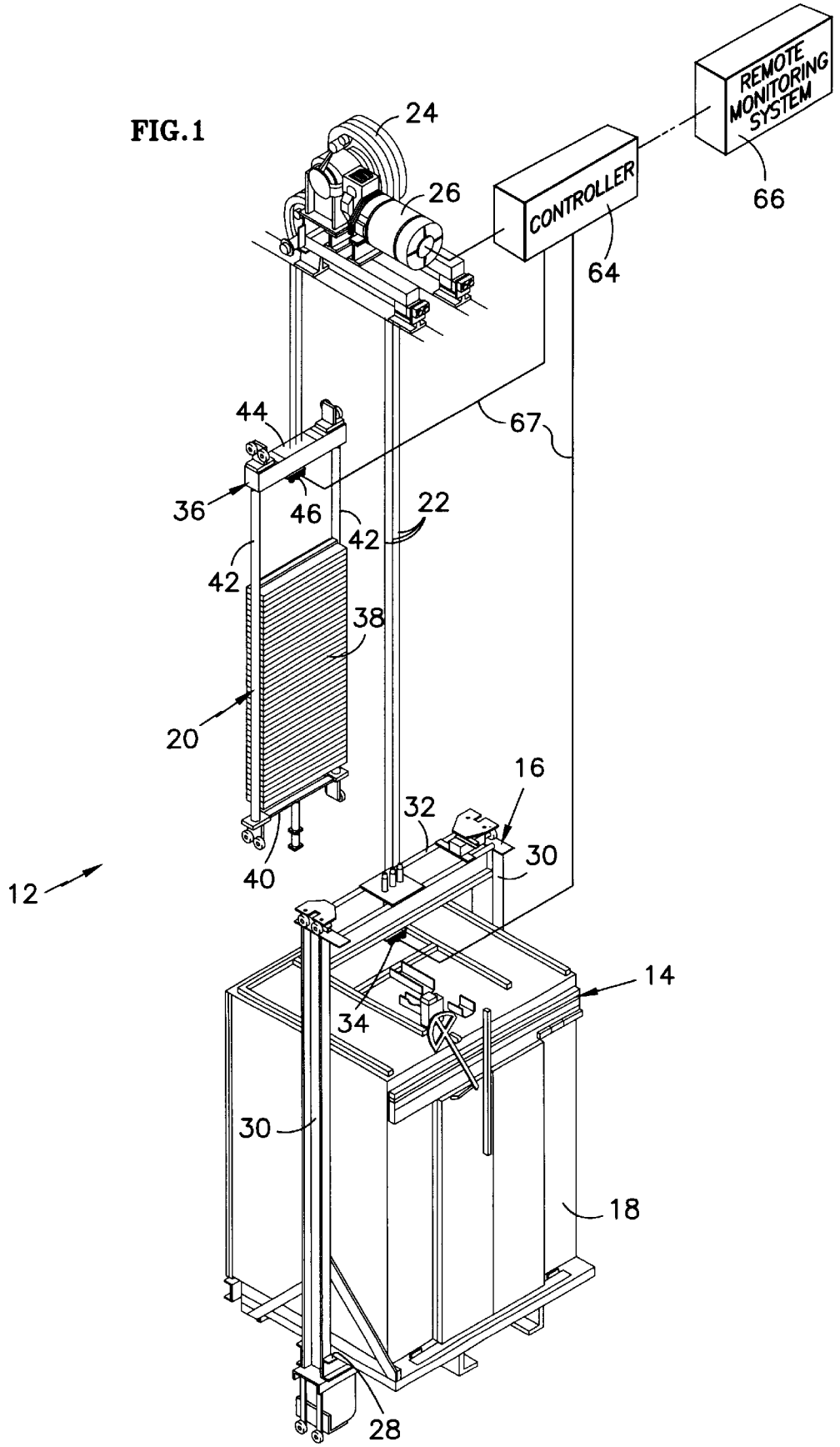
FIG. 1 is an illustration of an elevator system.

Illustrated in FIG. 1 is an elevator system 12. The elevator system 12 includes a car 14 having a car frame 16 and a cab 18, a counterweight 20, a plurality of ropes 22, a traction sheave 24, and a machine 26. The car 14 and the counterweight 20 are connected by the plurality of ropes 22. The plurality of ropes 22 extend over the sheave 24. Rotation of the sheave 24 causes the ropes 22 to move, as a result of the traction forces between the sheave and ropes 22, and thereby moves the counterweight 20 and car 14 through a hoistway (not shown in FIG. 1). The machine 26 provides the rotational force on the sheave 24.

The car frame 16 includes a plank 28, a pair of uprights 30, and a cross-head 32. The cab 18 is disposed within the car frame 16 and is supported by the plank 28. The ropes 22 are connected to the cross-head 32 through a hitch assembly 34.

The counterweight 20 includes a frame 36 and a plurality of weights 38. The frame 36 includes a plank 40, a pair of uprights 42, and a cross-head 44. As with the car frame 16, the ropes 22 are connected to the cross-head of the counterweight 20 through a hitch assembly 46.

Figure 2:
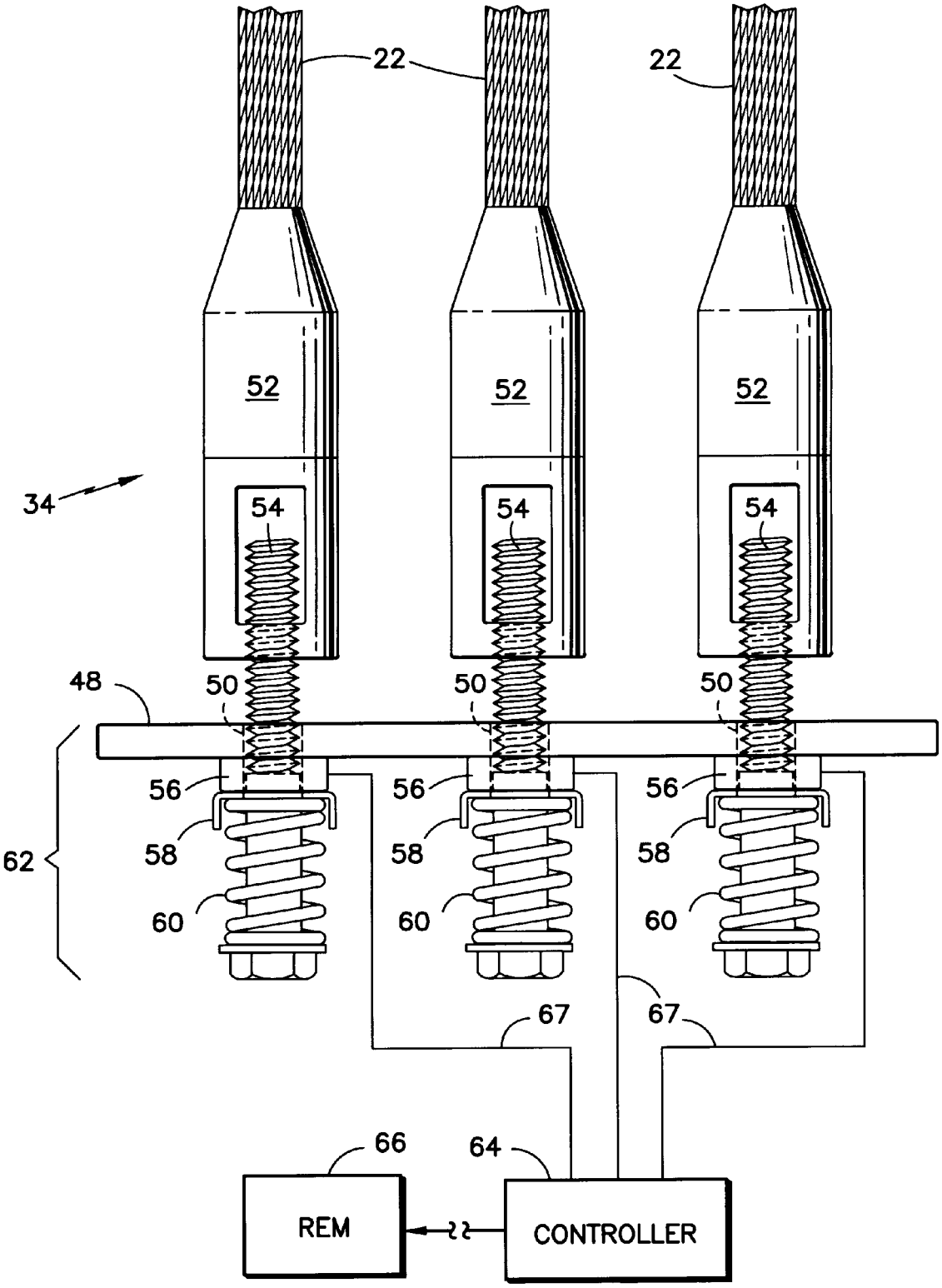
FIG. 2 is a side view of a plurality of ropes engaged with a rope monitoring assembly.

The hitch assembly 34 for the car frame 16 is shown in FIG. 2. Although not illustrated in detail, the hitch assembly 46 of the counterweight 20 is similar to the hitch assembly 34 of the car frame 16. The hitch assembly 34 includes a hitch plate 48 having an aperture 50 for each of the plurality of ropes 22.

Each rope 22 is engaged with a termination 52, a threaded rod 54, a load cell 56, a retainer 58, and a spring 60. The threaded rod 54 provides means to adjust the engagement between the termination 52 and the hitch assembly 34. The retainer 58 provides a seat for the spring 60 and mates up against the load cell 56. The spring 60 provides means to isolate the car frame 16 from vibrations in the ropes 22.

The load cells 56 form part of a rope monitoring assembly 62. The rope monitoring assembly 62 includes the plurality of load cells 56 on the car frame 16 and the counterweight 20, a controller 64, a remote monitoring system 66, and means 67 to communicate between the load cells 56 and the controller and remote monitoring system 66. The load cells 56 are sensors that provide an output that corresponds to the sensed level of tension carried by the rope 22 to which the load cell 56 is engaged. In this configuration, compressive forces are applied to the load cells 56 by the springs 60 and retainers 58. These compressive forces correlate with the tension in the ropes 22. This output is then communicated to the controller 64 and, if necessary, the controller 64 communicates a warning signal to the remote monitoring system 66. In addition to the warning signal, or in the alternative, the controller 64 may also communicate the sensed tension levels directly to the remote monitoring system 66. In an alternate embodiment, the rope monitoring system 62 does not include a remote elevator monitoring system 66 and the controller 64 stores the warning signal for later review by an on-site elevator mechanic.

In addition to their function as part of the rope monitoring assembly, the load cell 56 may also be used in place of a load weighing device to supply information on the passenger and/or freight load in the car 14. This information can be used for other functions of the elevator system 12, such as the determination of the proper amount of pre-torque to apply to the machine to avoid undesirable movement of the car 14 after the machine brake is released.

During operation of the elevator system 12, the load cells 56 sense the level of tension in each rope 22 and communicate these levels to the controller 64. The controller 64 monitors these levels and compares the sensed level of tension in the plurality of ropes 22. If all the ropes 22 are healthy, the sensed levels of tension in the ropes 22 should be approximately the same. On the other hand, if one of the ropes 22 has become damaged or degraded prematurely, the level of tension in this rope 22 will be reduced and, correspondingly, the level of tension in the other ropes 22 will be increased. This difference in the sensed level of tension defines a deviation. If the controller 64 determines that there is a deviation in the sensed level of tension in one rope 22 that is greater than a predetermined threshold, a warning signal is generated by the controller 64. This warning signal is communicated to the remote monitoring system 66 to indicate that this particular rope 22 requires inspection by a service mechanic. If the deviation exceeds a second, larger threshold, which is predetermined based upon the breaking strengths of the ropes 22 and a suitable factor of safety, the controller 64 will shut-down the elevator system 12.

In addition, the controller 64 compares the sensed levels of tension in each rope 22 from both the car frame 16 mounted load cells 56 and from the counterweight 20 mounted load cells 56. Comparing the level of tension in the ropes 22 on the car 14 side to the counterweight 20 side may be used to detect the occurrence of a slack rope condition and the elevator system can be immediately shut down to prevent an unsafe operating condition. Detection of such a condition by the controller 64 may provide an indication that inspection of the elevator system 12 is required.

Although applicable to both metallic and non-metallic hoist ropes, this feature is particularly advantageous for non-metallic ropes as a result of the higher coefficients of friction that are possible. The controller may simply compare the tension levels in the ropes on the car side versus the counterweights side and stop the operation of the elevator system if a significant deviation occurs, which may indicate a slack rope condition. As an alternative, the controller may monitor the tension in the ropes on the counterweight side and shut down the elevator if the rate of change in tension levels is excessive or if the sensed level of tension approaches zero.

In an alternative embodiment, the controller 64 determines the mean level of tension in the plurality of ropes 22 and then compares the sensed level of tension in the individual ropes 22 to this mean level of tension. If the sensed level of tension in any rope 22 exceeds a first predetermined threshold a warning signal is generated by the controller 64, and if the sensed level exceeds a second threshold, the elevator system 12 is shut-down.

In a second alternative embodiment, the controller 64 identifies the maximum level of tension and the minimum level of tension in the plurality of ropes 22. The controller 64 then determines the deviation between the sensed maximum and minimum levels and compares this deviation to threshold values to determine if a warning signal should be generated or if the elevator system 12 should be shut-down.

To determine the location of the excessively worn or damaged section of a rope, the level of tension in each rope may be monitored continuously. As the worn/damaged section travels over the sheave, a change should occur in the sensed levels of tension for that rope. This will result from the movement of the worn/damaged section between the car side and the counterweight side. The timing of this occurrence may be coordinated with a conventional position system of the elevator car to locate the worn/damaged section. Locating such sections of the rope may facilitate subsequent inspection of the rope.

Although the embodiments shown and described with respect to FIGS. 1 and 2 include load cells 56 as tension sensors, it should be apparent to those skilled in the art that other sensors may be used to sense the tension in the ropes, such as strain gages. Further, the load cells 56 may be mounted directly in the rope or hitch assembly such that they are subject to tensile forces, rather than compressive forces as shown in FIG. 2. In addition, the embodiment of FIGS. 1 and 2 includes tension sensors on both the car frame 16 and counterweight 20. It should be apparent that a single group of tension sensors may be used and that they may be located on the car frame 16, the counterweight 20, or any other convenient location that provides an output indicative of the tension in the ropes 22. Further, if the elevator car is roped in a manner other than the 1:1 roping used in FIGS. 1 and 2 to illustrate the invention, the tension sensors may be located remotely from the car and/or counterweight, such as proximate to a dead-end hitch.

Although the invention has been shown and described with respect to exemplary embodiments thereof, it should be understood by those skilled in the art that various changes, omissions, and additions may be made thereto, without departing from the spirit and scope of the invention.

What is claimed is:

1. A rope monitoring assembly for an elevator system having a car and a plurality of ropes, each of the plurality of ropes engaged with the car, the rope monitoring assembly including a plurality of tension sensors, each tension sensor engaged with one of the ropes and providing an output that corresponds to the tension within that rope, and a device that compares the relative levels of tension within the plurality of ropes.

2. The rope monitoring assembly according to claim 1, wherein the device is a controller, wherein the plurality of tension sensors communicate with the controller, and wherein the controller monitors the sensed level of tension in each rope.

3. The rope monitoring assembly according to claim 2, wherein the controller generates a warning signal if one of the plurality of tension sensors indicates that the tension within the rope engaged with that tension sensor deviates from a predetermined value.

4. The rope monitoring assembly according to claim 2, wherein the controller compares the sensed level of tension within the plurality of ropes and generates a warning signal if the tension within one of the plurality of ropes deviates from the level of tension in the other of the plurality of ropes by more than a predetermined value.

5. The rope monitoring assembly according to claim 2, wherein the controller compares the sensed level of tension within the plurality of ropes with the mean tension in the plurality of ropes and generates a warning signal if the tension within one of the plurality of ropes deviates from the mean level of tension in the plurality of ropes by more than a predetermined value.

6. The rope monitoring assembly according to claim 2, wherein the controller compares the sensed level of tension within the plurality of ropes, determines the maximum sensed level of tension and the minimum sensed level of tension, and generates a warning signal if the range between the maximum sensed level of tension and the minimum sensed level of tension is greater than a predetermined value.

7. The rope monitoring assembly according to claim 1, wherein the outputs of the plurality of tension sensors are communicated to a remote monitoring device.

8. The rope monitoring assembly according to claim 3, wherein the warning signal is communicated to a remote monitoring device.

9. A rope monitoring assembly for an elevator system having a car, a counterweight, a sheave and a plurality of ropes, each of the plurality of ropes engaged with the car, the counterweight and the sheave to define a car side and a counterweight side of the ropes, the rope monitoring assembly including a plurality of tension sensors, each tension sensor engaged with one of the ropes and providing an output that corresponds to the tension within that rope, and wherein the plurality of tension sensors includes a first group of tension sensors engaged with the ropes and positioned on the car side of the ropes, and a second group of tension sensors engaged with the ropes and positioned on the counterweight side of the ropes, such that there is a pair of tension sensors engaged with each rope.

10. The rope monitoring assembly according to claim 9, further including a controller, wherein the plurality of tension sensors communicate with the controller, and wherein the controller monitors the sensed level of tension from each tension sensor.

11. The rope monitoring assembly according to claim 10, wherein the controller generates a warning signal if one of the pairs of tension sensors indicates that the tension within the rope deviates from one side of the sheave to the opposite side of the sheave by more than a predetermined value.

12. A method to monitor ropes for an elevator system, the elevator system including a car and a plurality of ropes, each of the plurality of ropes engaged with the car, the method including the steps of:

operating the elevator system;

sensing the tension in each of the plurality of ropes during the operation of the elevator system; and comparing the relative levels of tension within the plurality of ropes.

13. The method according to claim 12, further including the step of generating a warning signal if the sensed tension in one of the plurality of ropes deviates from a predetermined value.

14. The method according to claim 12, further including the step of generating a warning signal if the tension within one of the plurality of ropes deviates from the level of tension in the other of the plurality of ropes by more than a predetermined value.

15. The method according to claim 12, further including the steps of determining the mean tension in the plurality of ropes, comparing the sensed level of tension within each of the plurality of ropes with the mean tension, and generating a warning signal if the tension within one of the plurality of ropes deviates from the mean level of tension by more than a predetermined value.

16. The method according to claim 12, further including the steps of comparing the sensed level of tension within the plurality of ropes, determining the maximum sensed level of tension, determining the minimum sensed level of tension, and generating a warning signal if the range between the maximum sensed level of tension and the minimum sensed level of tension is greater than a predetermined value.

17. The method according to claim 12, further including the step of communicating the sensed tension levels to a remote monitoring device.

18. The method according to claim 13, further including the step of communicating the warning signal to a remote monitoring device.

19. A method to monitor ropes for an elevator system the elevator system including a car, a counterweight, a sheave, and a plurality of ropes each of the plurality of ropes engaged with the car, the counterweight and the sheave to define a car side and a counterweight side of the ropes, the method including the steps of:

operating the elevator system; and sensing the tension in each of the plurality of ropes during the operation of the elevator system wherein the step of sensing the tension in the plurality of ropes includes sensing the tension of the ropes on the car side, and sensing the tension on the counterweight side.

20. The method according to claim 19, further including the step of generating a warning signal if the tension within the rope deviates from one side of the sheave to the opposite side of the sheave by more than a predetermined value.

21. The method according to claim 12, further including the step of shutting down the operation of the elevator system if the sensed tension levels indicate a slack-rope condition for the elevator system.

22. The rope monitoring system according to claim 1, further including a position reference system, and wherein the device monitors the tensions in the ropes continuously during operation of the elevator system to detect changes in the sensed levels of rope tensions and coordinates the sensed change in tension with the position reference system such that the location of the change may be determined.

23. The rope monitoring system according to claim 9, further including a position reference system and a device that monitors the tensions in the ropes continuously during operation of the elevator system to detect changes in the sensed levels of rope tensions and that coordinates the sensed change in tension with the position reference system such that the location of the change may be determined.

24. The method according to claim 12, wherein the elevator system further includes a position reference system, and wherein the step of sensing the tensions in the ropes is performed continuously during operation of the elevator system to detect changes in the sensed levels of rope tensions, and including a step of determining the location of the sensed change in tension by coordinating sensing of the change in tension with the position reference system.

25. The method according to claim 19, wherein the elevator system further includes a position reference system, and wherein the step of sensing the tensions in the ropes is performed continuously during operation of the elevator system to detect changes in the sensed levels of rope tensions, and including a step of determining the location of the sensed change in tension by coordinating sensing of the change in tension with the position reference system.

26. The rope monitoring system according to claim 9, wherein one end of the ropes is secured to the car, such that the car side of the ropes extends from the sheave to the car, and wherein the tension sensors are disposed to sense the tension in the ropes between the sheave and car.

27. The rope monitoring system according to claim 9, wherein one end of the ropes is secured to the counterweight, such that counterweight side of the ropes extends from the sheave to the counterweight, and wherein the tension sensors are disposed to sense the tension in the ropes between the sheave and counterweight.

28. The method according to claim 19, wherein one end of the ropes is secured to the car, such that the car side of the ropes extends from the sheave to the car, and wherein the step of sensing the tension of the ropes on the car side includes sensing the tension in the ropes between the sheave and car.

29. The method according to claim 19, wherein one end of the ropes is secured to the counterweight, such that counterweight side of the ropes extends from the sheave to the counterweight, and wherein the step of sensing the tension of the ropes on the counterweight side includes sensing the tension in the ropes between the sheave and the counterweight.

* * * * *